US005724675A

United States Patent [19]

Lipkin et al.

[11] Patent Number: 5,724,675

[45] Date of Patent: Mar. 10, 1998

[54] CAP WITH CROWN FORMED OF TWO SEGMENTS

[75] Inventors: Charles A. Lipkin, Golden Valley; Eugene E. Lassek, Columbia Heights, both of Minn.

[73] Assignee: Adcom of Iowa, Grant City, Mo.

[21] Appl. No.: 710,322

[22] Filed: Sep. 17, 1996

[51] Int. Cl.[6] ..... A42B 1/04

[52] U.S. Cl. ..... 2/195.1; 2/172; 2/181; 2/182.1; 2/182.6; 2/195.3; 2/195.5; 2/200.1

[58] Field of Search ..... 2/172, 175.1, 175.4, 2/181, 181.2, 182.1, 182.2, 182.6, 195.1, 195.3, 195.5, 200.1

[56] References Cited

U.S. PATENT DOCUMENTS

| | | | |
|---|---|---|---|
| 1,092,429 | 4/1914 | Centner | 2/181 |
| 1,598,313 | 8/1926 | Rosenberg | 2/195.1 |
| 2,869,134 | 1/1959 | Milstein | 2/195.1 |
| 2,994,090 | 8/1961 | Ostwald | 2/182.1 |
| 3,035,273 | 5/1962 | Krystal | 2/195.3 |
| 3,512,180 | 5/1970 | Bonk et al. | 2/172 |
| 4,662,007 | 5/1987 | Lipkin . | |

*Primary Examiner*—Diana Biefeld

*Attorney, Agent, or Firm*—Zarley, McKee, Thomte, Voorhees, & Sease

[57] ABSTRACT

The cap of the invention has a crown portion comprised of a plurality of segments, a visor extending outwardly from the forward lower edge of the crown portion, and an earflap foldable with respect to the crown and extending rearwardly around the lower periphery of the crown from one side thereof to the other. An upstanding band is secured to the inside of the crown portion to the forward lower edge thereof. The band has a sufficient height to provide a compartment to receive an elongated piece of elastic or foam material. The flap portion is a part of the single piece of the elastic material comprising the rearward segment of the crown. The earflap is defined by a generally horizontally disposed fold line dividing the rearward segment into an upper portion and the earflap portion. The forward segment of the crown is comprised of an outer fabric layer, a central stiffener layer, and an inner foam layer forming a single laminated layer.

23 Claims, 4 Drawing Sheets

CAP WITH CROWN FORMED OF TWO SEGMENTS

BACKGROUND OF THE INVENTION

Prior art caps such as those shown in U.S. Pat. No. 4,662,007 have certain shortcomings. While some have intended cap designs to provide a single cap for all sizes, this has not been realistically accomplished. Thus, cap retailers and corporate logo promoters still commonly have to stock a plurality of hat sizes.

Fabrication costs in the highly competitive cap industry are critical. Nevertheless, existing caps are normally comprised of a plurality of segments which must be stitched or otherwise secured together, all at great relative cost.

Further, caps of the baseball cap style are not usually warm enough for frigid weather.

It is therefore a principal object of this invention to provide a cap which has the rearward segment of the crown portion, and the earflap portion, comprised of a single piece of material.

A further object of the invention is to provide a cap device that has the capability of being suitably worn by substantially all cap users regardless of head size.

A still further object of this invention is to provide a cap which is stable, and which provides head warmth in cold weather. These and other objects of the invention will be apparent to those skilled in the art.

SUMMARY OF THE INVENTION

The cap of the invention has a crown portion comprised of a plurality of sections, a visor extending outwardly from the forward lower edge of the crown portion, and an earflap foldable with respect to the crown and extending rearwardly around the lower periphery of the crown from one side thereof to the other. An upstanding band is secured to the inside of the crown portion to the forward lower edge thereof. The band has a sufficient height to provide a compartment to receive an elongated piece of elastic or foam material.

The flap portion is a part of the single piece of the elastic material comprising the rearward segment of the crown. The earflap is defined by a generally horizontally disposed fold line dividing the rearward segment into an upper portion and the earflap portion.

The forward segment of the crown is comprised of an outer fabric layer, a central stiffener layer, and an inner foam layer, laminated together in a composite laminated layer.

DESCRIPTION OF THE PREFERRED EMBODIMENT

Figure 1:
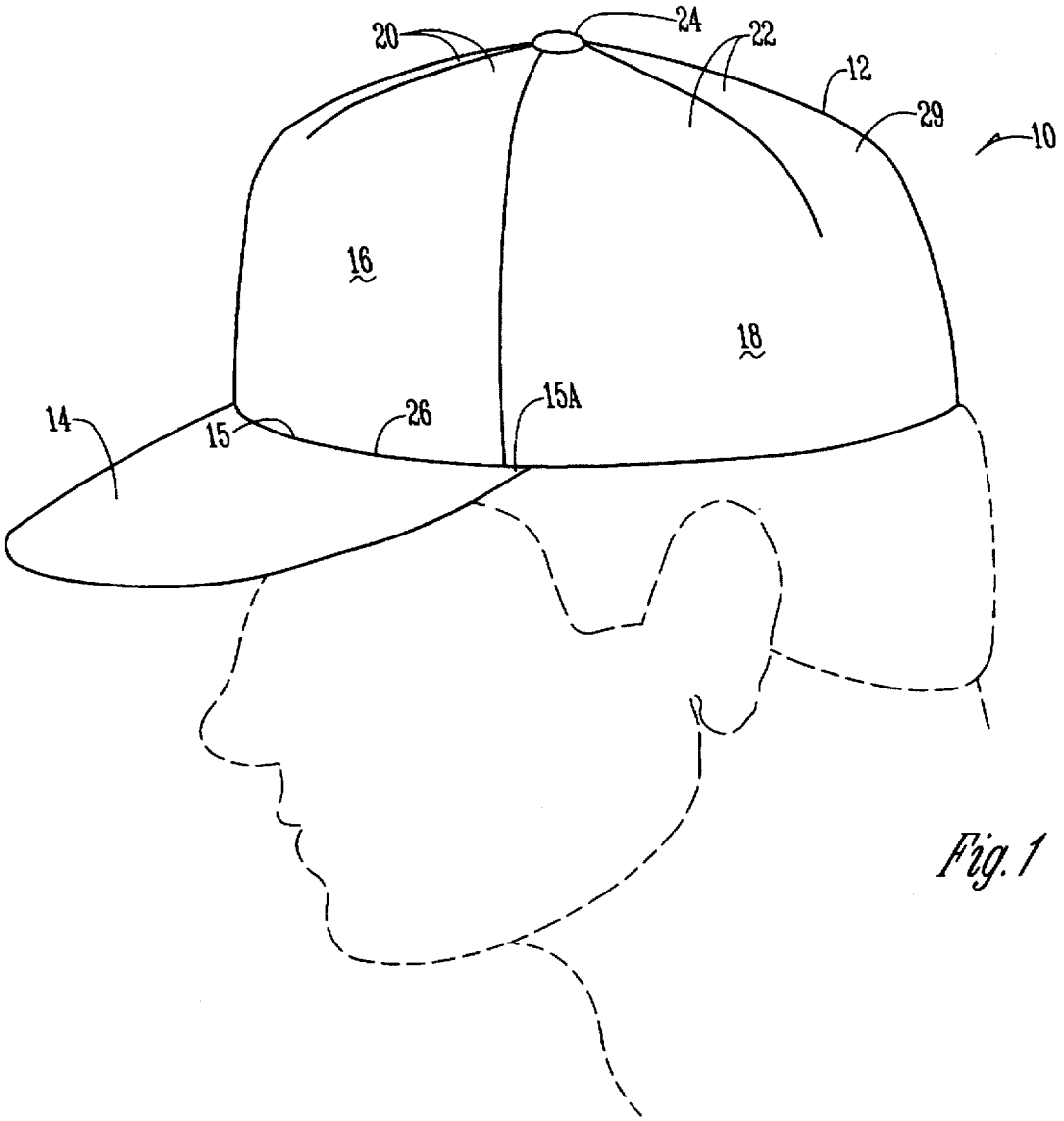
FIG. 1 is a perspective view of the cap of this invention with the wearer of the cap being denoted in dotted lines.

The cap 10 has a crown 12 and a forwardly extending visor 14 secured to the forward lower edge of the crown. The visor has a rearward curved edge 15 (FIG. 1) with opposite ends 15A.

Figure 6:
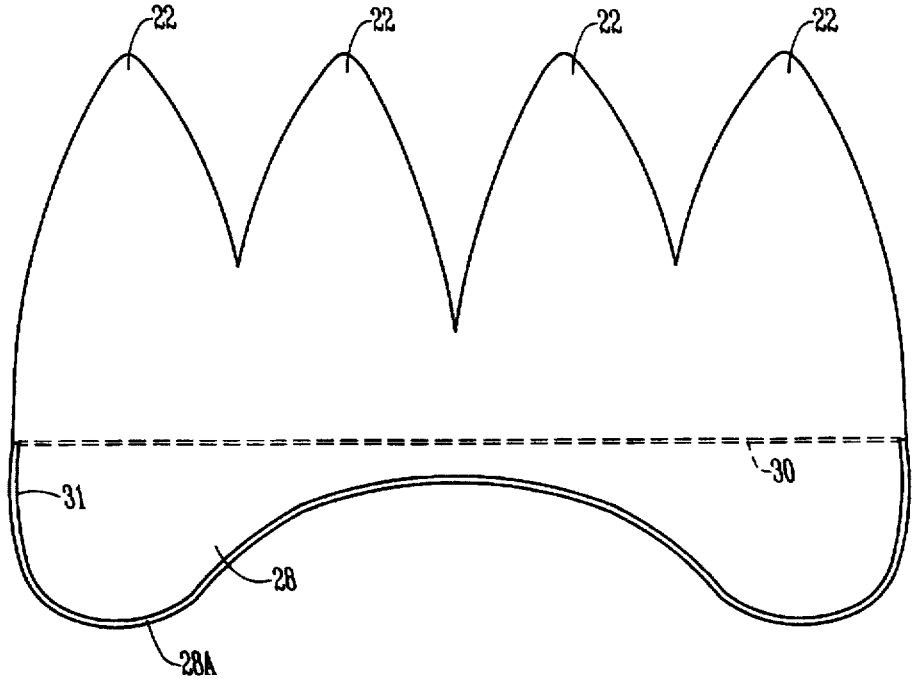
FIG. 6 is a plan view of the rearward segment of the crown portion before it is assembled into the cap construction.

The crown is comprised of a forward segment 16 which is comprised of layers of single pieces of materials laminated together; and a rearward segment 18 of knit fabric which is also comprised of a single piece of material. The forward segment 16 is a one piece panel with a top darted seam sewn within the interior of crown 12. Similarly, the rearward segment 18 is a one section cut piece sewn into three darted seams created in the same manner. The forward segment 16 is divided into two forward sections 20 separated by a darted seam; and the rearward segment 18 is divided into four sections created in the same manner. An earflap portion 28 is located directly below the upper portion 29 of rearward segment 18 by a fold line 30 which is merely a sewn seam extending substantially horizontally (FIG. 6) within the upper segment 18. The earflap 28 has forward opposite ends 31. The lower peripheral edge 28A of the earflap portion 28 can have an elastic binding sewn therein to make the earflap portion tighten against the ears, face and neck of the wearer to keep out the cold and wind.

Figure 2:
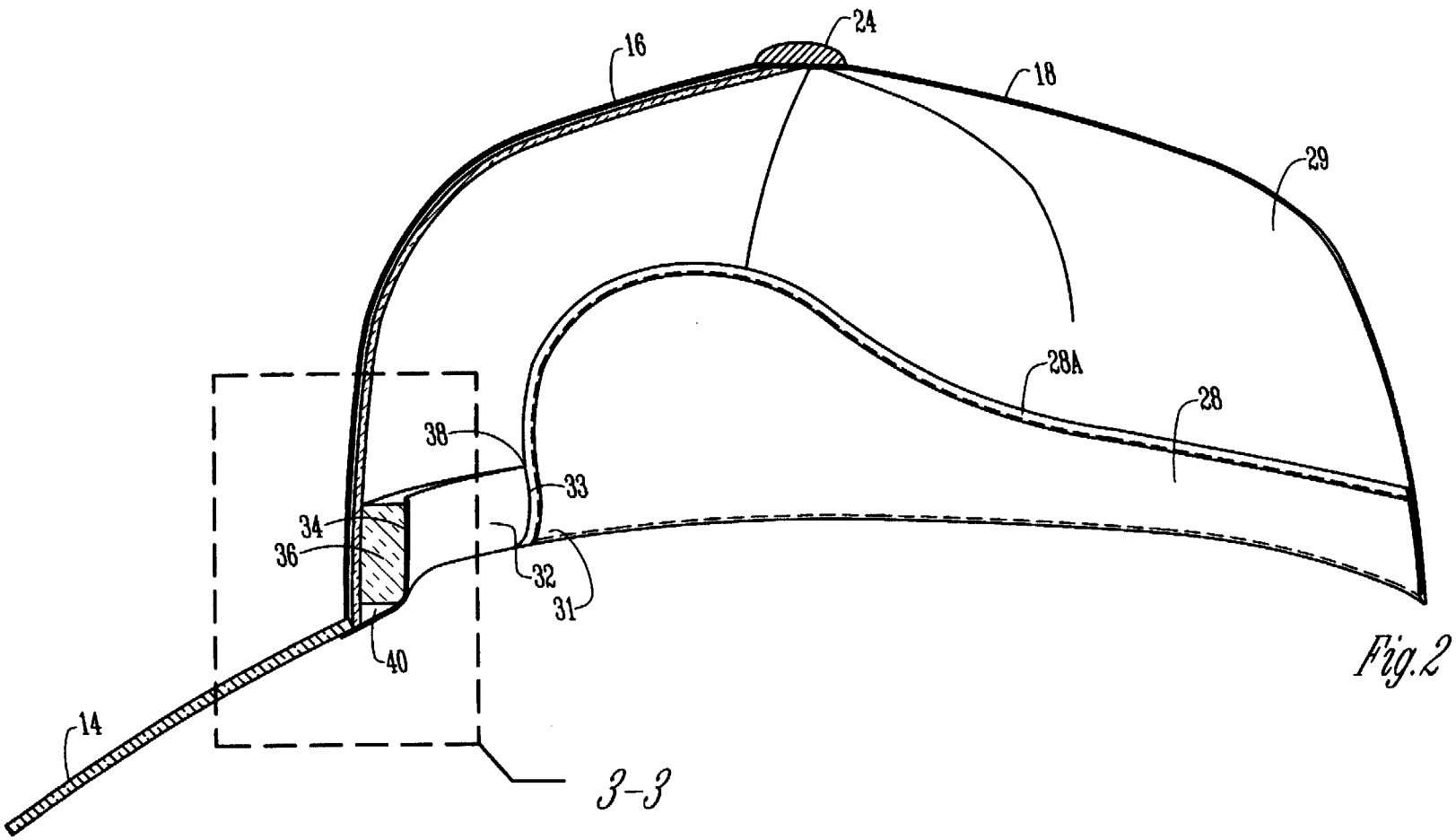
FIG. 2 is an enlarged scale longitudinal sectional view of the cap of FIG. 1 with the earflaps folded upwardly inside of the crown.
Figure 4:
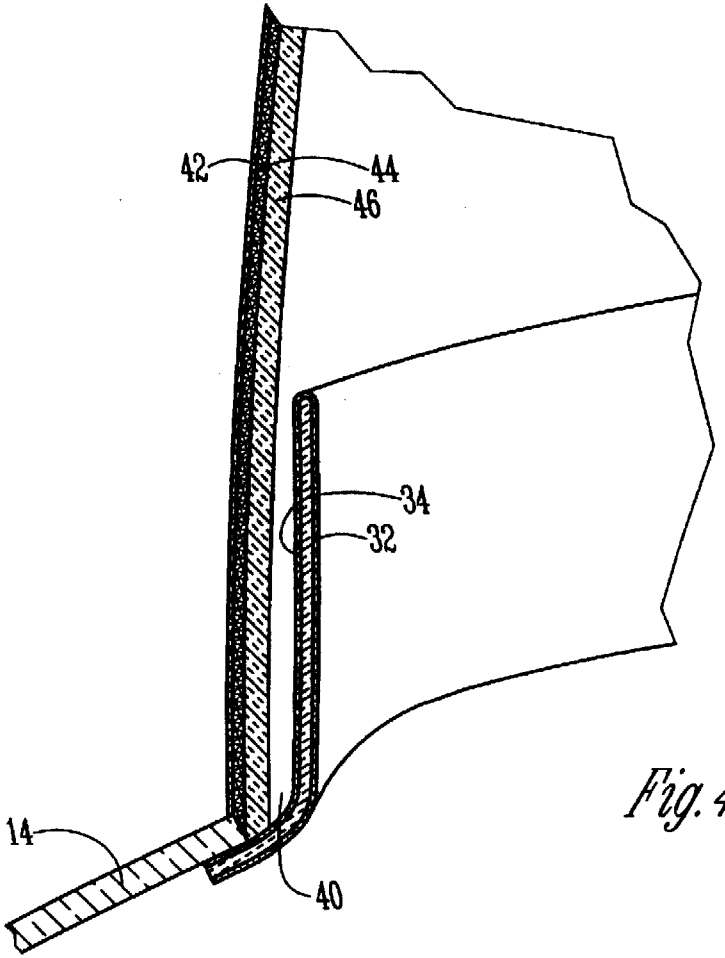
FIG. 4 is a view similar to that of FIG. 3 with the elongated foam material being removed from the position shown in FIG. 3.
Figure 3:
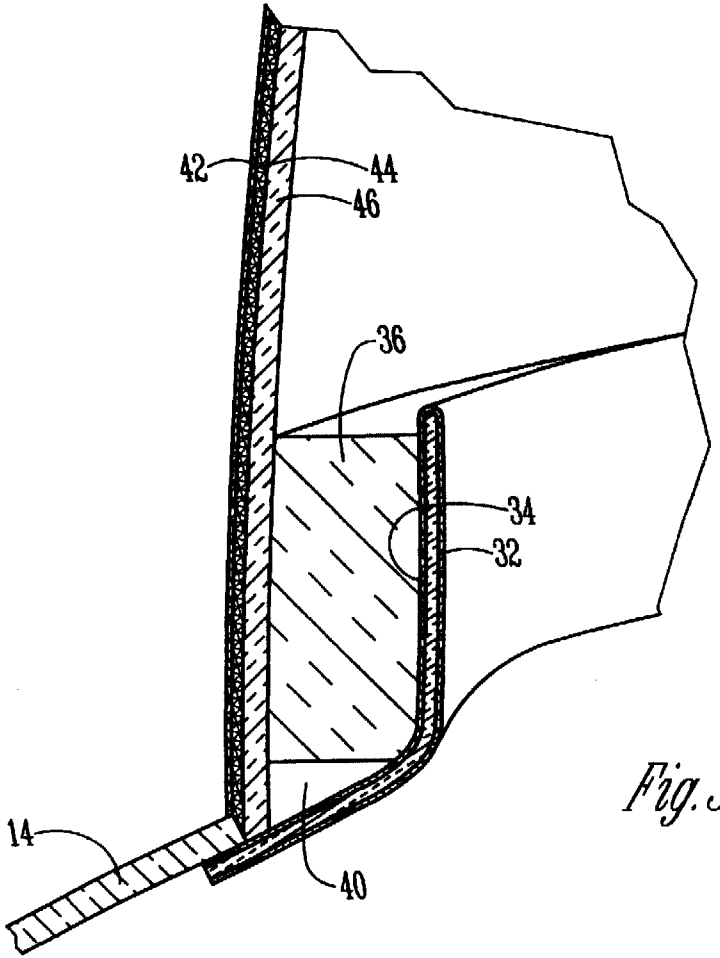
FIG. 3 is an enlarged scale sectional view taken on line 3—3 of FIG. 2 with the elongated foam layer being in position adjacent the upstanding band.

With reference primarily to FIGS. 2, 3 and 4, a band 32 with opposite ends 33 is located inside the crown and is secured by its lower edge to the rearward curved edge of visor 14 (FIG. 2). The band 32 has a forward surface The vertical height of band 32 is greater than that of conventional caps and has a height in the order of 1¾ inches to 2 inches. An elongated compressible foam member 36 is mounted between the forward surface 34 of the band and the forward portion of the crown 12. The ends 33 of band 32 can be tacked or otherwise sewn (see the numeral 38 in FIG. 2) to the crown to create the compartment 40 in which the foam member 36 is mounted.

The forward segment 16 of crown 12 is comprised of an outer fabric layer 42, a central stiffener layer 44 of buckram or the like, an interior foam layer 46. These three layers add substantial warmth and stability to the cap.

The rearward segment 18 can have an inner layer of material secured thereto if desired. However, the outer layer shown as rearward segment 18 in the drawings should be comprised of a single piece of elastic material.

Figure 5:
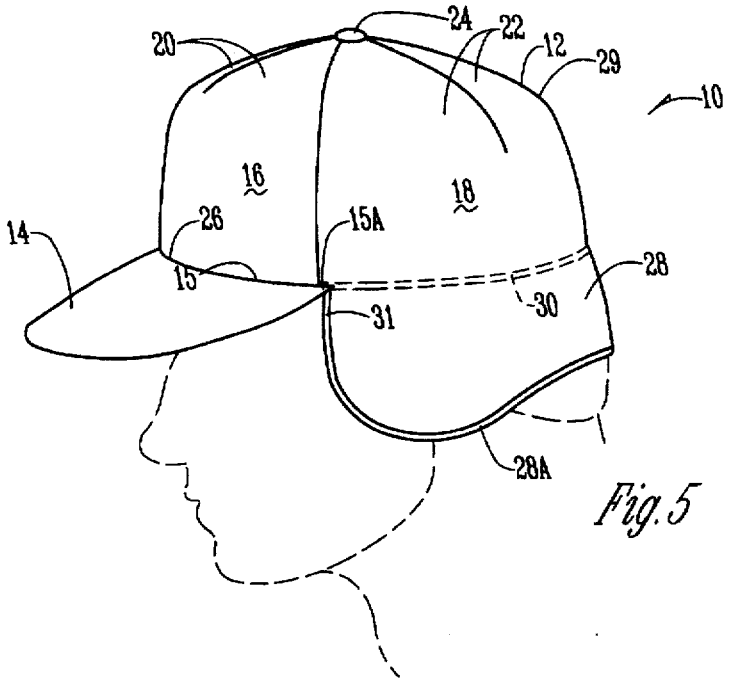
FIG. 5 is a perspective view of the cap of this invention similar to that of FIG. 1 but with the earflap portion in its operative position.

The cost of fabrication of the cap is greatly reduced by making both the forward segment 16 and the rearward segment 18 of single cut pieces of material. Further, the rearward segment of the cap is further enhanced from a manufacturing point of view by making the earflap portion 28 of the same piece of material as the upper portion 29 of the rear segment 18. The fold line 30 provides a comfortable and automatic fold line for the earflap portion 28 when it is moved from its stored position in FIG. 2 to its operative position in FIG. 5, and vice versa.

The height of the band 32 is very important because when the elongated foam layer 36 is inserted into compartment a portion of the band must assume a substantial horizontal position plus a vertical portion to retain the foam member. A shallow band would not be able to accommodate this arrangement.

For a person having a smaller head size, the cap is well adaptable to fit that person by the use of the presence of the foam member 36 being located in compartment 40. Persons having a slightly larger head size would merely cause the foam member 36 to be slightly compressed, wherein the cap would fit just as well as it did on the person having even a smaller head size. For persons having large head sizes, the foam strip could be removed as shown in FIG. 4, and again this cap would accommodate even the larger range of head sizes.

From the foregoing, it is seen that this invention will achieve at least all of its stated objectives.

What is claimed is:

1. A cap having a crown portion comprised of a plurality of gores, a visor extending outwardly from a forward lower edge of the crown portion, an earflap portion foldable with respect to the crown and extending rearwardly around the lower periphery of said crown portion from one side thereof to the other, and an upstanding band secured to the inside of said crown portion at the forward lower edge thereof, the improvement comprising, said crown portion comprising only a forward segment and a rearward segment directly connected together, said rearward segment having an outer edge comprising a single piece of elastic material.

2. The cap of claim 1 wherein said earflap portion is a part of the single piece of elastic material comprising said rearward segment.

3. The cap of claim 2 wherein said earflap portion has a generally horizontally disposed fold line dividing said earflap portion from an upper portion of the rearward segment of said crown portion.

4. The cap of claim 3 wherein said fold line is created by an elongated line of stitching in a lower segment of said crown portion.

5. The cap of claim 3 wherein said visor has a rearward curved edge joined to the forward lower edge of the crown portion and terminating in opposite ends, said fold line for said earflap portion having forward opposite ends positioned adjacent the opposite ends, respectively, of the rearward curved edge of said visor.

6. The cap of claim 2 wherein said earflap portion has a lower peripheral edge which contains an elongated elastic member to cause the earflap portion to tighten against the face, neck and ears of the wearer of the cap.

7. The cap of claim 1 wherein the upstanding band is elastic and is secured at a lower edge thereof to the lower forward edge of the crown portion, said band member having a forward surface, and a compressible elongated member located between the forward surface of said band member and the forward segment of said crown portion.

8. The cap of claim 7 wherein said band member has opposite ends located adjacent the opposite ends of a rearward curved edge of said visor, with the opposite ends of said band member being secured to the forward segment of said crown portion.

9. The cap of claim 7 wherein said compressible elongated member is comprised of foam material.

10. The cap of claim 7 wherein said band has a vertical height of at least 1¾ inches.

11. The cap of claim 1 wherein said forward segment of said crown portion is comprised of an outer fabric layer, a central stiffener layer, and an inner foam layer.

12. A cap having a crown portion comprised of a plurality of segments, a visor extending outwardly from a forward lower edge of the crown portion, an earflap portion foldable with respect to the crown and extending rearwardly around the lower periphery of said crown portion from one side thereof to the other, and an upstanding band secured to the inside of said crown portion at the forward lower edge thereof, the improvement comprising, said crown portion comprising a forward segment and a rearward segment, said forward segment being comprised of an outer fabric layer, a central stiffener layer, and an inner foam layer.

13. The cap of claim 12 wherein said crown portion comprises only said forward segment and said rearward segment directly connected together.

14. A cap having a crown portion comprised of a plurality of segments, a visor extending outwardly from a forward lower edge of the crown portion, an earflap portion foldable with respect to the crown and extending rearwardly around the lower periphery of said crown portion from one side thereof to the other, and an upstanding band secured to the inside of said crown portion at the forward lower edge thereof, the improvement comprising, said crown portion comprising only a forward segment and a rearward segment directly connected together, said band having a forward surface, and a compressible elongated member positioned between the forward surface of said band member and the forward segment of said crown portion.

15. The cap of claim 14 wherein said compressible elongated member is comprised of foam material.

16. The cap of claim 14 wherein said band and said compressible elongated member have a length that extends along a lower edge of said forward segment of said crown portion.

17. The cap of claim 14 wherein said forward segment of said crown portion is comprised of an outer fabric layer, a central stiffener layer, and an inner foam layer.

18. The cap of claim 17 wherein said layers of said forward segment are laminated together.

19. A cap having a crown portion comprised of a plurality of gores, a visor extending outwardly from a forward lower edge of the crown portion, an earflap portion foldable with respect to the crown and extending rearwardly around the lower periphery of said crown portion from one side thereof to the other, and an upstanding band secured to the inside of said crown portion at the forward lower edge thereof, the improvement comprising, said crown portion comprising a forward segment and a rearward segment, said rearward segment having an outer edge comprising a single piece of elastic material, said earflap portion being a part of the single piece of elastic material comprising said rearward segment, said earflap portion having a generally horizontally disposed fold line dividing said earflap portion from an upper portion of the rearward segment of said crown portion, and said fold line being created by an elongated line of stitching in a lower segment of said crown portion.

20. A cap having a crown portion comprised of a plurality of gores, a visor extending outwardly from a forward lower edge of the crown portion, an earflap portion foldable with respect to the crown and extending rearwardly around the lower periphery of said crown portion from one side thereof to the other, and an upstanding band secured to the inside of said crown portion at the forward lower edge thereof, the improvement comprising, said crown portion comprising a forward segment and a rearward segment, said rearward segment having an outer edge comprising a single piece of elastic material, said upstanding band being elastic and being secured at a lower edge thereof to the lower forward edge of the crown portion, said band member having a forward surface, and a compressible elongated member located between the forward surface of said band member and the forward segment of said crown portion, said band member having opposite ends located adjacent the opposite ends of a rearward curved edge of said visor, with the opposite ends of said band member being secured to the forward segment of said crown portion.

21. A cap having a crown portion comprised of a plurality of gores, a visor extending outwardly from a forward lower edge of the crown portion, an earflap portion foldable with respect to the crown and extending rearwardly around the lower periphery of said crown portion from one side thereof to the other, and an upstanding band secured to the inside of said crown portion at the forward lower edge thereof, the improvement comprising, said crown portion comprising a forward segment and a rearward segment, said rearward segment having an outer edge comprising a single piece of elastic material, said forward segment of said crown portion being comprised of an outer fabric layer, a central stiffener layer, and a inner foam layer.

22. A cap having a crown portion comprised of a plurality of segments, a visor extending outwardly from a forward lower edge of the crown portion, an earflap portion foldable with respect to the crown and extending rearwardly around the lower periphery of said crown portion from one side thereof to the other, and an upstanding band secured to the inside of said crown portion at the forward lower edge thereof, the improvement comprising, said crown portion comprising a forward segment and a rearward segment, said band having a forward surface, and a compressible elongated member positioned between the forward surface of said band member and the forward segment of said crown portion, said forward segment of said crown portion being comprised of an outer fabric layer, a central stiffener layer, and an inner foam layer.

23. The cap of claim 22 wherein said layers of said forward segment are laminated together.

* * * * *